US005383403A

United States Patent [19]

Nordvall

[11] Patent Number: 5,383,403

[45] Date of Patent: Jan. 24, 1995

[54] ARRANGEMENT IN AN INFRARED DRYER FOR A SHEET OFFSET PRESS

[75] Inventor: Per Nordvall, Tranås, Sweden

[73] Assignee: IVT Graphics AB, Tranas, Sweden

[21] Appl. No.: 949,240

[22] PCT Filed: May 10, 1991

[86] PCT No.: PCT/SE91/00334

§ 371 Date: Nov. 10, 1992

§ 102(e) Date: Nov. 10, 1992

[87] PCT Pub. No.: WO91/17890

PCT Pub. Date: Nov. 28, 1991

[30] Foreign Application Priority Data

May 11, 1990 [SE] Sweden ..... 9001733

[51] Int. Cl.[6] ..... B41F 35/00

[52] U.S. Cl. ..... 101/424.1; 101/487

[58] Field of Search ..... 101/424.1, 487, 488

[56] References Cited

U.S. PATENT DOCUMENTS

| | | | |
|---|---|---|---|
| 1,414,872 | 5/1922 | Frederick | 101/421.1 |
| 3,934,112 | 1/1976 | Lakhani | 101/488 |
| 4,449,453 | 5/1984 | Staffer et al. | 101/424.1 |
| 4,809,608 | 3/1989 | Wolnick et al. | 101/487 |
| 5,060,572 | 10/1991 | Waizmann | 101/421.1 |

FOREIGN PATENT DOCUMENTS

| | | | |
|---|---|---|---|
| 2412493 | 10/1974 | Germany | 101/421.1 |
| 2830094 | 5/1979 | Germany | 101/421.1 |
| 0147366 | 9/1983 | Japan | 101/421.1 |

*Primary Examiner*—Edgar S. Burr
*Assistant Examiner*—Anthony H. Nguyen
*Attorney, Agent, or Firm*—Ostrolenk, Faber, Gerb & Soffen

[57] ABSTRACT

An infrared drier in a sheet offset press having a low sheet discharge conveyor. The drier includes an infrared battery under which ready-print sheets are fed for drying ink fields on the sheets. The battery is situated under and adjacent to the ink rolls located in the last stand of the printing unit of the press. The battery is cooled by a cooling air system in which a supply air fan blows air into one end of the battery. The air is removed from the other end of the battery by an exhaust fan. An exhaust station is arranged under the drying position of the sheets under the battery and connected to the exhaust fan such that hot air is extracted from the ink rolls, as well as from a region adjacent the infrared battery.

1 Claim, 1 Drawing Sheet

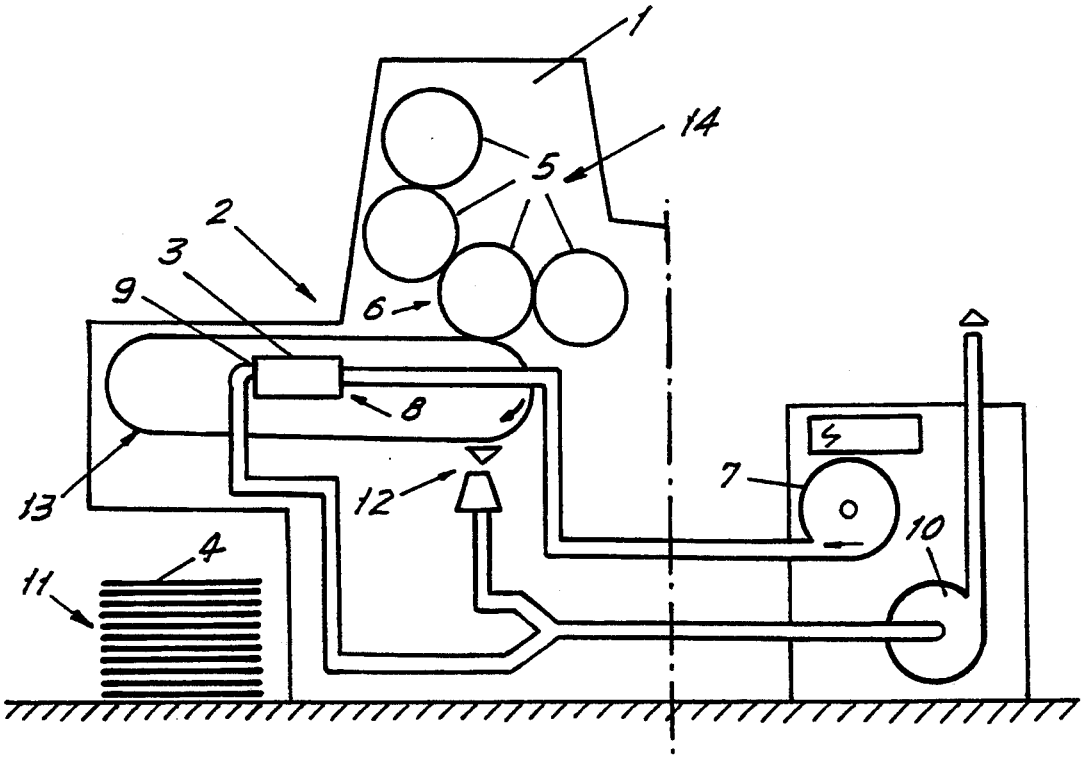
1
14
5
2
3
9
6
8
13
12
7
10
4
11

ARRANGEMENT IN AN INFRARED DRYER FOR A SHEET OFFSET PRESS

BACKGROUND OF THE INVENTION

1. Field of the Invention

The present invention relates to improvements in or relating to a sheet offset press, and more specifically to an arrangement of an infra-red (IR) drier for such presses having a low sheet discharge conveyor provided with an IR battery, ready printed sheets being passed under this battery for drying the ink fields on the sheets, and the battery being situated under, or close to the ink rolls in the last stand of the press.

2. Description of the Related Art

In previously known machines of the type mentioned above, spray powder has been used in drying the printed sheets before stacking the individual sheets. With this procedure the sheets can be stacked before they are properly dry. A disadvantage is, however, that large space is required in the press hall for these stacks of sheets that are put out to dry off, and the drying time may amount to several hours. In addition, large quantities of spray powder are consumed in preventing the individual sheets from sticking to each other in the stacks. Attempts have of course been made to use IR lamps for drying the ink on the sheets inside an offset press of the kind in question, but there has been a problem with the heat generated by an IR drier for providing a good driving effect in the process because drying of the moisture on the platens in the press also occurs. This is due to the ink rolls in the last stand generally being placed above or close to the stack of sheets, where the IR drier must also be placed.

SUMMARY OF THE INVENTION

One object of the present invention is to provide an arrangement with an IR drier of the kind mentioned in the introduction, where the disadvantages mentioned have been eliminated. This object is achieved with an arrangement described above, and with the characterizing features disclosed in the claims.

According to the present invention there has now been achieved an arrangement which meets its purpose in an excellent way, while being cheap and simple to manufacture at the same time. Apart from an effective cooling of the IR battery, the connections to the IR lamps, the lamps themselves as well as their electric cables are also cooled. Since the IR battery is cooled using a "closed" air cooling system, any leakage of air is avoided, and simultaneously cooling will be very effective. With the aid of the exhaust station there is obtained a sufficient air stream/change of air round the IR drier inside the press, the air to the exhaust station coming from the press hall via a grid at the ink rolls adjacent the stack of sheets and through other openings, thus providing the ventilation required for preventing the heat occurring in the drying process from migrating up through the press, which would cause the above-mentioned problems. The combination of IR battery and exhaust station provides a sufficiently "cold" printing press, so that setoff against the platens is avoided.

BRIEF DESCRIPTION OF THE DRAWING

The invention will now be described in more detail below, and with reference to the accompanying drawing, which illustrates a schematic cross section of the arrangement of an IR battery for a sheet offset press with a low sheet discharge conveyor in accordance with the present invention.

DETAILED DESCRIPTION OF THE PREFERRED EMBODIMENT

In the drawing there is shown a preferred embodiment of an IR drier 2 in accordance with the present invention in a sheet offset press 1 with a low sheet discharge conveyor 13. The drier 2 includes an IR battery 3, known per se, in combination with an air cooling system. The ink rolls 5 of the last stand 6 in a printing unit 14 of the press 1 are arranged, as will be seen from the drawing, above or adjacent a stack 11 of sheets 4, close to where the IR battery 3 must be placed. An air cooling system is connected to the battery 3, a supply air fan 7 blows air into one end 8 of the battery 3, such as to emerge from its other end 9 for removal by an exhaust fan 10. This air also cools the terminals of the IR lamps, the lamps themselves as well as the electric cables. There is an exhaust station 12 disposed directly at the drying position of the sheets 4 under the IR battery 3. This station is also being connected to the exhaust fan 10 for extracting hot air from the ink rolls 5 in the unit 14, as well as from a region adjacent the IR battery 3. This exhaust station prevents the heat occurring during the drying process from migrating up through the unit 14 to cause setoff against the printing platens.

The IR drier in accordance with the invention is operated from a panel having the functions ON, OFF, infinitely variable IR effect 0–100%, and temperature indication measured by a transducer at the stack 11 of sheets 4. The drier 2 is interlocked to the "start printing" function of the press 1. At "start printing" the IR lamps are turned on, the supply air fan 7 sends a cooling air stream to the IR battery 3, and the exhaust fan 10 is in operation. For "terminate printing" the lamps are extinguished, but the fans keep going for approximately two minutes. This enables the fans to vent off the post operation heat in the battery 3 and conveyor 13. This is kept up in the mentioned order for each printing run. The temperature in the stack is taken about 2 or 3 cms from the uppermost sheet 4, and should be about 35°–40° C. where there are inked areas on the sheets. This temperature may depend on the use of different colours and inks, paper weight etc.

I claim:

1. An infrared drier for a sheet offset press, the drier being situated under ink rolls of the press, the drier comprising:

an infrared battery having opposed ends, under which printing sheets are arranged to be fed for drying ink fields on the sheets;

an air cooling system for cooling the infrared battery, the cooling system including a supply air fan for blowing air into one end of the infrared battery and an exhaust fan for removing heated air from the other end of the infrared battery; and an exhaust station communicating with the exhaust fan for removing heated air from the ink rolls of the press and from a region adjacent the infrared battery.

* * * * *